US010373785B2

(12) United States Patent
Kosse

(10) Patent No.: US 10,373,785 B2
(45) Date of Patent: Aug. 6, 2019

(54) SWITCHGEAR WITH A GAS-TIGHT INSULATING SPACE

(71) Applicant: Siemens Aktiengesellschaft, Munich (DE)

(72) Inventor: Sylvio Kosse, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/752,684

(22) PCT Filed: Jul. 21, 2016

(86) PCT No.: PCT/EP2016/067405
§ 371 (c)(1),
(2) Date: Feb. 14, 2018

(87) PCT Pub. No.: WO2017/045811
PCT Pub. Date: Mar. 23, 2017

(65) Prior Publication Data

US 2018/0240626 A1 Aug. 23, 2018

(30) Foreign Application Priority Data

Sep. 18, 2015 (DE) ..... 10 2015 218 003

(51) Int. Cl.
*H01H 33/22* (2006.01)
*H01H 33/70* (2006.01)
(Continued)

(52) U.S. Cl.
CPC ..... *H01H 33/22* (2013.01); *H01H 33/021* (2013.01); *H01H 33/7023* (2013.01); *H01H 33/91* (2013.01); *H01H 85/38* (2013.01)

(58) Field of Classification Search
CPC ..... H01H 33/22; H01H 85/38; H01H 33/021; H01H 33/7023; H01H 33/91
See application file for complete search history.

(56) References Cited

U.S. PATENT DOCUMENTS 4,562,322 A 12/1985 Yamaguchi et al. ..... 218/85
4,958,052 A 9/1990 Mahieu ..... 218/51
(Continued)

FOREIGN PATENT DOCUMENTS

CN 1518029 A 8/2004 ..... H01H 33/66
CN 104054151 A 9/2014 ..... H01H 33/70
(Continued)

OTHER PUBLICATIONS

German Office Action, Application No. 102015218003.4, 7 pages, dated Jun. 22, 2016.
(Continued)

*Primary Examiner* — Truc T Nguyen
(74) *Attorney, Agent, or Firm* — Slayden Grubert Beard PLLC

(57) ABSTRACT

The present disclosure relates to switchgear. Various embodiments may include medium- or high-voltage switchgear with a gas-tight insulating space. For example, a switchgear may include: a gas-tight insulating space where an insulating gas is kept above atmospheric pressure and two switching contacts in the space. At least one of the contacts may movable with respect to a nozzle. The insulating gas may include a mixture of at least 90% by mass of nitrogen and oxygen or nitrogen and carbon dioxide. The nozzle may include a plastic with at least 65% by mass in total of the elements carbon, nitrogen, and oxygen.

4 Claims, 3 Drawing Sheets

(51) Int. Cl.

| | |
|---|---|
| ***H01H 33/91*** | (2006.01) |
| ***H01H 33/02*** | (2006.01) |
| ***H01H 85/38*** | (2006.01) |

(56) References Cited

U.S. PATENT DOCUMENTS

| | | | | |
|---|---|---|---|---|
| 5,925,863 | A | 7/1999 | Zehnder et al. | 218/53 |
| 2004/0159635 | A1 | 8/2004 | Sato et al. | 218/154 |
| 2014/0367361 | A1 | 12/2014 | Horinouchi et al. | 218/117 |
| 2015/0083691 | A1* | 3/2015 | Matsui | H01H 33/143 218/3 |
| 2015/0084722 | A1* | 3/2015 | Sugiyama | H01H 33/143 335/154 |
| 2015/0206683 | A1* | 7/2015 | Ohda | H01H 33/666 335/153 |
| 2015/0228375 | A1* | 8/2015 | Kieffel | H01B 3/56 361/604 |
| 2015/0357137 | A1* | 12/2015 | Kubo | H01H 33/06 218/90 |
| 2017/0162349 | A1* | 6/2017 | Girodet | C01B 13/02 |

FOREIGN PATENT DOCUMENTS

| | | | | |
|---|---|---|---|---|
| DE | 19622753 | C1 | 8/1997 | H01H 33/76 |
| DE | 19645525 | A1 | 5/1998 | C08K 3/00 |
| EP | 0673965 | A1 | 9/1995 | C08K 3/22 |
| EP | 2887367 | A1 | 6/2015 | H01H 1/38 |
| WO | 2013/153110 | A1 | 10/2013 | H01H 33/70 |
| WO | 2017/045811 | A1 | 3/2017 | H01H 33/22 |

OTHER PUBLICATIONS

International Search Report and Written Opinion, Application No. PCT/EP2016/067405, 9 pages, dated Oct. 6, 2016.

Chinese Office Action, Application No. 201680053604.X, 6 pages, dated Oct. 31, 2018.

* cited by examiner

SWITCHGEAR WITH A GAS-TIGHT INSULATING SPACE

CROSS-REFERENCE TO RELATED APPLICATIONS

This application is a U.S. National Stage Application of International Application No. PCT/EP2016/067405 filed Jul. 21, 2016, which designates the United States of America, and claims priority to DE Application No. 10 2015 218 003.4 filed Sep. 18, 2015, the contents of which are hereby incorporated by reference in their entirety.

TECHNICAL FIELD

The present disclosure relates to switchgear. Various embodiments may include medium- or high-voltage switchgear with a gas-tight insulating space.

BACKGROUND

Gas-insulated medium- or high-voltage installations, in particular based on the principle of the so-called puffer circuit breaker or self-blast circuit breaker, have an inert, and in particular electrically insulating gas. This insulating gas serves on the one hand for insulating electric currents flowing in the interior of the switch from the housing and on the other hand for extinguishing an arc, in particular in the interior of the switchgear. Sulfur hexafluoride $SF_6$ is usually used for this. $SF_6$ has very good insulating properties and very good arc extinguishing properties, but has a very high greenhouse potential, for which reason use of this insulating gas is in question.

During the extinction of an arc that occurs when the switching contact opens, parts of the $SF_6$ and of the nozzle material decompose, the nozzle generally consisting of polytetrafluoroethylene. These decomposition products generally recombine again after the extinction of the arc and after cooling down, in particular on the surface of the nozzle. In the case of existing switchgear, it has proven to be practicable to combine $SF_6$ as an insulating and extinguishing gas on the one hand and PTFE as a nozzle material on the other hand. When an alternative gas is used, it has however been found to combine unfavorably with the existing nozzle material. Recombination products occur, with adverse effects on the surface of the nozzle and on the functionality of the switchgear. In particular, they are not environmentally friendly because of the fluorine that is bound up in the PTFE.

SUMMARY

The teachings of the present disclosure may be embodied in medium- or high-voltage switchgear that has an alternative insulating gas to the established $SF_6$ and in the case of which there is less occurrence of recombination products with harmful effects on the operation of the installation after the extinction of an arc. Such an installation may include a gas-tight insulating space, in which an insulating gas is kept above atmospheric pressure.

For example, some embodiments may include medium- or high-voltage switchgear with a gas-tight insulating space (4), in which an insulating gas (6) is kept above atmospheric pressure and at least two switching contacts (8, 10) are arranged, at least one switching contact (8, 10) being mounted movably with respect to a nozzle (12), characterized in that the insulating gas (6) is a mixture containing in total respectively at least 90% by mass nitrogen and oxygen or nitrogen and carbon dioxide and in that the nozzle (12) consists at least partially of a plastic which contains at least 65% by mass in total of the elements carbon, nitrogen and oxygen.

In some embodiments, the plastic contains less than 1% by mass, or less than 0.1% by mass, fluorine.

In some embodiments, the plastic comprises polyamide or polyimide.

In some embodiments, the nozzle (12) and at least one switching contact (8, 10) are arranged symmetrically in relation to one another with respect to an axis of rotation (13).

BRIEF DESCRIPTION OF THE DRAWINGS

Further embodiments and further features of the disclosure are explained in more detail on the basis of the following figures, in which.

DETAILED DESCRIPTION

In some embodiments, the installation provides at least two switching contacts, which are arranged in the insulating space, at least one switching contact being mounted movably with respect to a nozzle. In some embodiments, the insulating gas is a mixture consisting in total of respectively at least 90% by mass nitrogen and oxygen or at least 90% by mass a mixture of nitrogen and carbon dioxide. The two alternative insulating gases mentioned are either air, in particular purified air, which is optionally also synthesized, and a so-called biogen, that is to say a mixture of nitrogen and carbon dioxide, this containing up to 40% carbon dioxide. Moreover, the nozzle consists at least partially of a plastic which contains at least 65% in total of the elements carbon, nitrogen and oxygen. This means that the plastic contains all three of these elements, and that the total of the masses of these elements is at least 65% of the overall mass of the plastic. In some embodiments, the mass of these elements is around 70% or 75%, of the mass of the plastic.

The combination of a mixture of nitrogen and carbon or nitrogen and oxygen and the use of a plastic that indeed consists of carbon, nitrogen and oxygen, or contains them to a significant extent, has the effect that substances which are related in terms of their chemical composition are produced during the decomposition of the insulating gas and during the decomposition of the plastic during the extinction of the arc. The recombination of these substances therefore does not cause any harmful substances to occur with adverse effects on the operation of the nozzle on the one hand and the action of the insulating gas on the other hand. It is preferably even the case that the original substance recombines.

In some embodiments, the plastic of the nozzle contains as little fluorine as possible, in particular less than one % by mass, and/or less than 0.1% by mass fluorine. This is expedient because fluorine compounds in particular are generally not environmentally friendly, and likewise have adverse properties when this fluorine compound is deposited on surfaces.

In some embodiments, the nozzle comprises polyamide or polyimide. For example, a typical polyamide that is used as the construction material comprises 39.6% by mass carbon, 5.9% hydrogen, 30.6% oxygen and 6.5% nitrogen. The remaining proportions are made up by fillers such as phosphorus, silicon, aluminum, calcium and zinc, which may be introduced into the plastic in particular as fire retardants.

In some embodiments, the nozzle and at least one switching contact are arranged symmetrically in relation to another with respect to an axis of rotation. It has the effect that the switching contact can be withdrawn from the nozzle surrounding it, and thereby produces a cylindrical space, in which the arc can spread and in which it can best be extinguished because it is a symmetrical space.

Figure 1:
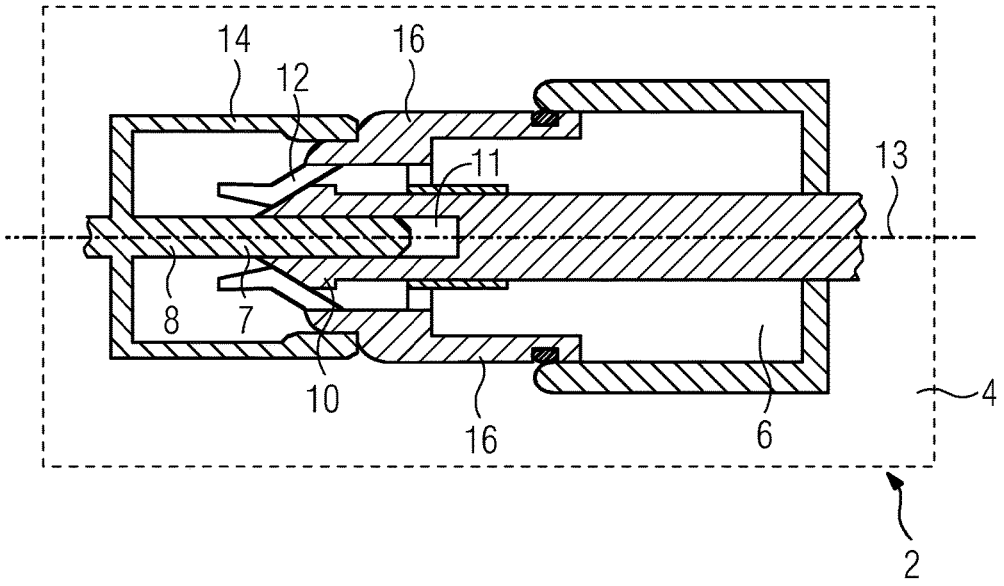
FIG. 1 to FIG. 5 show a switchgear, in particular the switching contacts, in various phases of opening and closing of the switch.

A schematic sequence known per se of a puffer circuit breaker is first to be described below, though the invention is not confined to the puffer circuit breaker. FIG. 1 shows a switchgear, whether a medium- or high-voltage switchgear, which has an insulating space 4, the insulating space 4 being schematically represented by dashed lines around the switching contacts 8 and 10. This means that the arrangement outside the switching contacts 8 and 10 is not considered in any more detail. The switching contacts 8 and 10 are rotationally symmetrical components which are arranged rotationally symmetrically around the axis of rotation 13. The switching contact 8 has a central pin 7, which is surrounded annularly by another switching contact 14.

Figure 2:
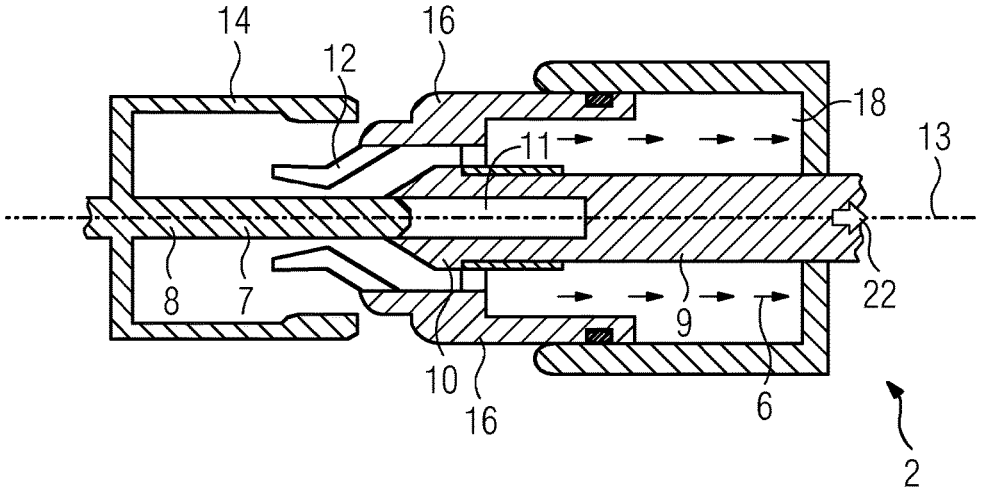

In some embodiments, these two parts 7 and 14 of the switching contact 8 are combined here to form an integrated component, the switching contact 8. Similarly, a second switching contact 10 likewise has a central pin 9, which in turn is surrounded rotationally symmetrically by an outer switching contact 16; these components also represent an integrated component, which is referred to here as switching contact 10. As shown in FIG. 2, in the closed state the central pin 7 fits into a bore 11, which has been introduced into the central pin 9 of the switching contact 10 along the axis of rotation 13. Furthermore, the outer switching contacts 14 and 16 touch, thereby forming the main flow path. Also provided is a nozzle 12, which consists of a plastic, and which is likewise arranged rotationally symmetrically around the central pin 7 of the switching contact 8 with respect to the axis of rotation 13.

During the opening of the switchgear 2, first the outer contacts 14 and 16 are separated from one another, for which at least one switching contact is withdrawn along the axis of rotation 13 by a drive, illustrated by the arrow 22. The overall separating operation in this case takes place in a few milliseconds, but after the separation of the outer contacts 14 and 16 the contact between the central pins 7 and 9 is at first maintained. Here, as shown in FIG. 2, the pin 7 is withdrawn from the bore 11 of the pin 9. At the same time, insulating gas 6, which is located in a compression chamber 18, is compressed. Furthermore, the nozzle 12 is attached to the switching contact 10 in such a way that it moves with respect to the pin 7 along the axis 13.

Figure 3:
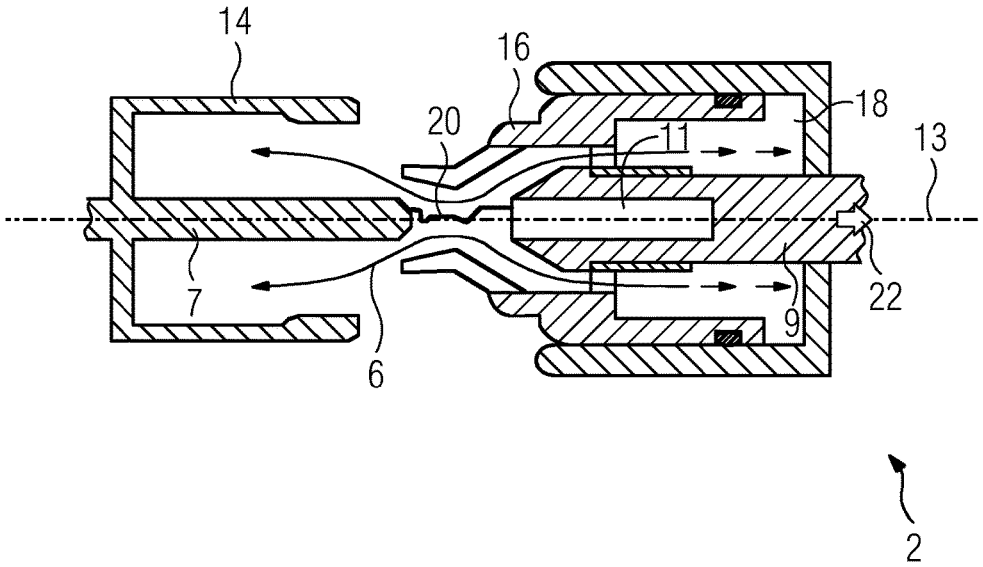

Once the separation of the two contacts 8 and 10 has proceeded to such an extent that the inner pins 7 and 9 also no longer touch, an arc 20 forms in the region of the nozzle 12 approximately along the axis of rotation 13. This is extinguished by the insulating gas 6, which flows out of the compression chamber 18, which is a component part of the contact 10. This insulating gas, which in this example is purified air with a composition of 80% nitrogen and 20% oxygen, flows along the arrows 6 in FIG. 3 around the arc 20 and extinguishes it. In combination with the nozzle material, which is a polyamide, this produces gaseous decomposition products on the basis of carbon, nitrogen and oxygen. The reason for this is that the polyamide as the nozzle material comprises substantially the same elements as is the case in the air. Particularly nitrogen and oxygen are main constituents of the polyamide. An alternative, likewise particularly expedient nozzle material is a polyimide. As an alternative to air, a so-called biogen, that is to say a mixture of nitrogen and oxygen, may likewise be used as the insulating gas 6.

Figure 4:
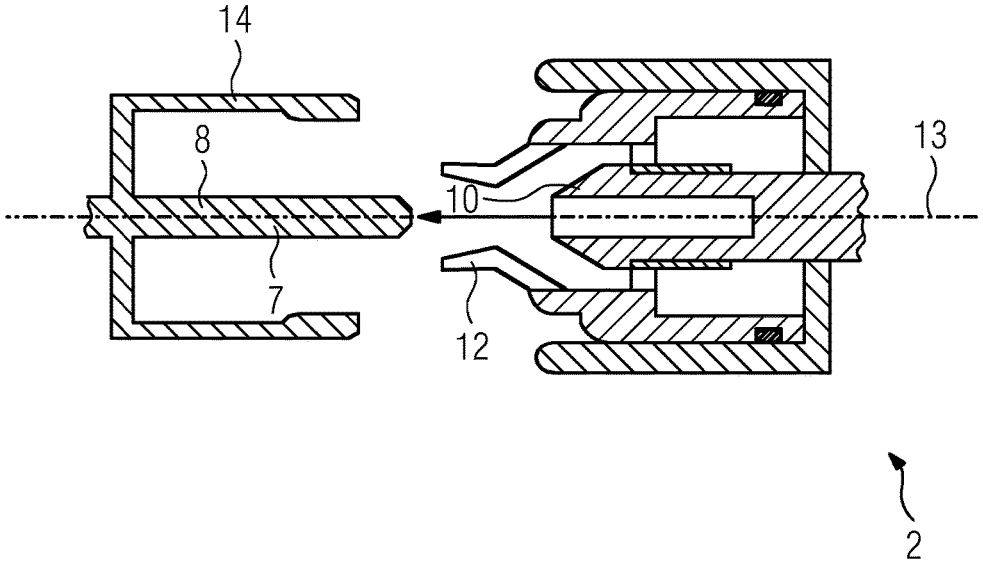
Figure 5:
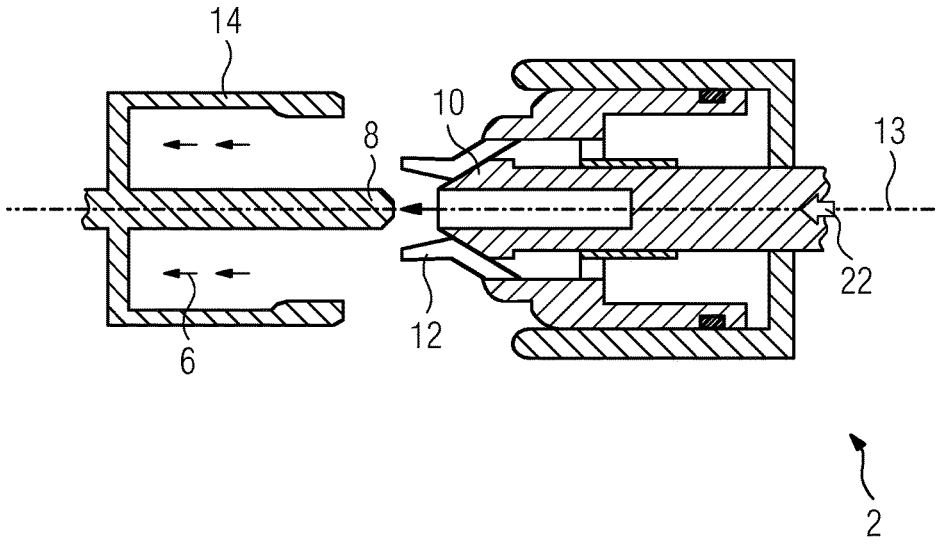

In some embodiments, after the extinction of the arc 20, the gaseous decomposition products that are produced at the high temperatures when the arc 20 occurs between the insulating gas and the nozzle materials are deposited on the nozzle 13. This recombination takes place in the opened state, as is shown for example in FIG. 4. FIG. 5 then shows in turn an opposite process, to be specific the closing operation of the switchgear 2. In this case, the drive 22, illustrated by the arrow 22, which is generally provided by compressed air or spring force, is moved along the axis of rotation 13 in the opposite direction and the switch is correspondingly closed.

As already mentioned, polyamides or polyimides may be used as materials for the nozzles. A typical polyamide in this case comprises 39.6% carbon, 5.9% hydrogen, 30.6% oxygen and 6.5% nitrogen. All of the percentages given here are % by mass. Also incorporated as fillers and flame retardants are phosphorus at 3.6%, silicon at 8.8%, aluminum at 2.7%, calcium at 1.7% and zinc at 0.6%. The three elements carbon, oxygen and nitrogen have here together a mass of 76.7%. As an alternative to this, a further polyamide is described, comprising 49% carbon, 8% hydrogen, 20.1% oxygen and 9.5% nitrogen. Here, too, fillers are also added, such as phosphorus at 2.6%, silicon at 5.4%, aluminum at 2.1%, calcium at 3.3%. The total of the elements carbon, oxygen and nitrogen is in this case 78.6%. In a third variant, a co-polyamide is used, containing 40% carbon, 4.4% hydrogen, 29.3% oxygen and 6.5% nitrogen. Here, the total of the elements carbon, oxygen and nitrogen is 75.8%.

In some embodiments, the plastic used for the nozzle contains at least 65% by mass of these three elements mentioned, carbon, oxygen and nitrogen. This amount of the materials mentioned ensures that no products that contaminate on the one hand the insulating gas and on the other hand the nozzle surface are produced as decomposition products.

Purified air, which may be synthesized from the main components nitrogen and oxygen, may be used as the insulating gas. Here, the mixture generally contains 80% nitrogen and 20% oxygen. In the case of natural air, there may also be a small proportion of carbon dioxide and also further gases, in particular noble gases in very small amounts. Furthermore, it is also expedient to use the so-called biogen, which is likewise based on nitrogen and contains up to 40% carbon dioxide, as the insulating gas 4.

Furthermore, in some embodiments, the plastic used for the nozzle 12 contains no fluorine, or only very little fluorine. In particular with carbon, which is contained in virtually all plastics, fluorine compounds form fluorocarbon compounds, which contaminate the insulating space 4 and also the switching contacts 8 and 10 and the nozzle 13. In some embodiments, the proportion of fluorine in the plastic is less than 1%, and/or less than 0.1%.

What is claimed is:

1. A switchgear comprising:

a gas-tight insulating space where an insulating gas is kept above atmospheric pressure; and two switching contacts arranged in the gas-tight insulating space;

wherein at least one of the two switching contacts is mounted movably with respect to a nozzle;

wherein the insulating gas comprises at least 90% by mass of nitrogen and oxygen or at least 90% by mass of nitrogen and carbon dioxide; and wherein the nozzle comprises a material made up of at least 65% by mass in total of carbon, nitrogen, and oxygen.

2. The switchgear as claimed in claim 1, wherein the nozzle comprises less than 1% by mass of fluorine.

3. The switchgear as claimed in claim 1, wherein the nozzle comprises at least one plastic chosen from the group consisting of: polyamide and polyimide.

4. The switchgear as claimed in claim 1, wherein the nozzle and the at least one of the two switching contacts are arranged symmetrically in relation to one another with respect to an axis of rotation.

* * * * *